US012318021B2

(12) United States Patent
McAndrew

(10) Patent No.: US 12,318,021 B2
(45) Date of Patent: Jun. 3, 2025

(54) BRACKET FOR USE WITH OPEN DISPLAY REFRIGERATORS

(71) Applicant: Aerofoil Energy Limited, Cheshire (GB)

(72) Inventor: Paul McAndrew, Cheshire (GB)

(73) Assignee: Aerofoil Energy Limited, Chesire (GB)

( * ) Notice: Subject to any disclaimer, the term of this patent is extended or adjusted under 35 U.S.C. 154(b) by 0 days.

(21) Appl. No.: 17/569,249

(22) Filed: Jan. 5, 2022

(65) Prior Publication Data

US 2022/0232999 A1 Jul. 28, 2022

Related U.S. Application Data

(63) Continuation of application No. PCT/GB2020/051580, filed on Jul. 1, 2020.

(30) Foreign Application Priority Data

Jul. 5, 2019 (GB) ..... 1909707

(51) Int. Cl.
*A47F 3/04* (2006.01)

(52) U.S. Cl.
CPC ..... *A47F 3/0447* (2013.01); *A47F 2003/046* (2013.01)

(58) Field of Classification Search
CPC .... A47F 3/0447; A47F 2003/046; A47F 3/04; A47F 5/0068; F25D 17/06; F25D 23/023
See application file for complete search history.

(56) References Cited

U.S. PATENT DOCUMENTS

| | | | | |
|---|---|---|---|---|
| 2,387,622 | A | 10/1945 | Tanner | |
| 2,822,672 | A | 2/1958 | Dickson et al. | |
| 3,063,252 | A | 11/1962 | Gilbert et al. | |
| 3,063,253 | A | 11/1962 | Dickson et al. | |
| 3,084,463 | A | 4/1963 | Reynolds et al. | |
| 3,747,726 | A | 7/1973 | Walter | |
| 4,221,443 | A | 9/1980 | Heaney | |
| 4,224,443 | A | 9/1980 | Stiefel | |
| 5,088,607 | A * | 2/1992 | Risafi et al. ..... | A47F 1/125 211/59.3 |
| 6,021,908 | A | 2/2000 | Mathews | |

(Continued)

FOREIGN PATENT DOCUMENTS

| | | | |
|---|---|---|---|
| CN | 101014268 | A | 8/2007 |
| CN | 101031225 | A | 9/2007 |

(Continued)

OTHER PUBLICATIONS

JP 2010207565 A Translation (Year: 2010).*

(Continued)

*Primary Examiner* — Elizabeth J Martin
*Assistant Examiner* — Dario Antonio Deleon
(74) *Attorney, Agent, or Firm* — Price Heneveld LLP

(57) ABSTRACT

A bracket for attaching an air curtain guide to a refrigerator shelf, the bracket comprising: a first end having a surface for engagement with an edge of a refrigerator shelf; a second end for coupling to an air curtain guide; wherein the first end is connected to the second end by a continuous member, such that the first end is offset from the second end in a first direction.

16 Claims, 7 Drawing Sheets

(56) References Cited

U.S. PATENT DOCUMENTS

| | | | | |
|---|---|---|---|---|
| 8,729,429 | B2 | 5/2014 | Nuttall et al. | |
| 9,370,262 | B2 | 6/2016 | Wirth | |
| D777,225 | S | 1/2017 | McAndrew | |
| D824,963 | S | 8/2018 | McAndrew | |
| D854,590 | S | 7/2019 | McAndrew | |
| 11,737,584 | B2 | 8/2023 | McAndrew | |
| 2005/0217297 | A1 | 10/2005 | Wilson | |
| 2006/0059934 | A1 | 3/2006 | Howington et al. | |
| 2007/0251253 | A1 | 11/2007 | Alahyari et al. | |
| 2008/0205040 | A1 | 8/2008 | Shibusawa et al. | |
| 2008/0236182 | A1 | 10/2008 | Hahn et al. | |
| 2012/0092350 | A1 | 4/2012 | Ganapathi et al. | |
| 2012/0255924 | A1 | 10/2012 | Kologe | |
| 2013/0112634 | A1 | 5/2013 | Nagel | |
| 2015/0208830 | A1 | 7/2015 | Hardy | |
| 2016/0302591 | A1 | 10/2016 | McAndrew | |
| 2018/0325284 | A1 | 11/2018 | McAndrewet al. | |
| 2019/0142186 | A1 | 5/2019 | Wirth | |
| 2019/0195552 | A1 | 6/2019 | Roesch et al. | |
| 2019/0274452 | A1 | 9/2019 | McAndrew | |
| 2019/0360738 | A1 | 11/2019 | McAndrew | |
| 2021/0298492 | A1* | 9/2021 | Wirth | A47F 5/0068 |
| 2021/0393052 | A1 | 12/2021 | McAndrew et al. | |
| 2022/0175155 | A1 | 6/2022 | McAndrew | |
| 2023/0404293 | A1 | 12/2023 | McAndrew | |
| 2023/0404294 | A1 | 12/2023 | McAndrew | |

FOREIGN PATENT DOCUMENTS

| | | | | | |
|---|---|---|---|---|---|
| CN | 109561769 | A | | 4/2019 | |
| EP | 0441357 | A2 | | 8/1991 | |
| EP | 0722158 | B1 | | 4/1999 | |
| FR | 2499698 | A1 | | 8/1982 | |
| FR | 2690825 | A1 | | 11/1993 | |
| FR | 2764787 | A1 | | 12/1998 | |
| GB | 249295 | A | | 3/1926 | |
| GB | 1120069 | A1 | * | 8/2001 | A47F 5/0068 |
| GB | 2527636 | A | | 12/2015 | |
| GB | 2541996 | A | | 3/2017 | |
| GB | 2560932 | A | | 10/2018 | |
| GB | 2563407 | A | | 12/2018 | |
| GB | 2571116 | A | | 8/2019 | |
| JP | S5072330 | A | | 6/1975 | |
| JP | S51150569 | U | | 12/1976 | |
| JP | S5374768 | U | | 6/1978 | |
| JP | S55165468 | A | | 12/1980 | |
| JP | S57152073 | U | | 9/1982 | |
| JP | S59174588 | U | | 11/1984 | |
| JP | S62162569 | U | | 10/1987 | |
| JP | 2004278865 | A | | 10/2004 | |
| JP | 2010207564 | A | | 9/2010 | |
| JP | 2010207565 | A | * | 9/2010 | A47F 3/04 |
| JP | 2011131036 | A | * | 7/2011 | F25D 17/08 |
| JP | 2011167384 | A | | 9/2011 | |
| JP | 2014198069 | A | | 10/2014 | |
| KR | 19990013134 | U | | 4/1999 | |
| KR | 20110092935 | A | | 8/2011 | |
| KR | 20120008561 | A | | 2/2012 | |
| WO | WO-2005023060 | A1 | | 3/2005 | |
| WO | WO-2008052721 | A1 | | 5/2008 | |
| WO | WO-2012112115 | A1 | | 8/2012 | |
| WO | WO-2014167320 | A1 | | 10/2014 | |
| WO | WO-2018200997 | A1 | | 11/2018 | |
| WO | WO-2019227119 | A1 | | 12/2019 | |
| WO | WO-2020229799 | A1 | | 11/2020 | |
| WO | WO-2021005335 | A1 | | 1/2021 | |

OTHER PUBLICATIONS

JP 2011131036 A Translation (Year: 2011).*

Examination Report, dated Dec. 19, 2022, for United Kingdom Patent Application No. GB1909707.0 (3 total pages).

Examination Report, dated Oct. 17, 2021, for Gulf Cooperation Counsel Application No. GC 2020-40045 (3 total page).

International Preliminary Report on Patentability, mailed Jan. 20, 2022, for PCT International Application No. PCTGB2020051580 (8 total pages).

International Search Report and Written Opinion for International Application No. PCT/GB2020/051580 mailed on Aug. 5, 2020, 9 pages.

Search Report, date Dec. 12, 2019, for United Kingdom Patent Application No. GB1909707.0 (4 total pages).

Co-pending U.S. Appl. No. 18/120,261, inventor McAndrew; Paul, filed Mar. 10, 2023.

Non-Final Office Action for U.S. Appl. No. 18/120,261 dated Oct. 4, 2023, 24 pages.

Non-Final Office Action for U.S. Appl. No. 18/221,217 dated Mar. 14, 2024, 11 total pages.

Notice of Allowance for U.S. Appl. No. 18/120,261 dated May 9, 2024, 8 pages.

Office Action and search report for United Kingdom Application No. GB2311449 mailed Aug. 30, 2023, 5 pages.

* cited by examiner

BRACKET FOR USE WITH OPEN DISPLAY REFRIGERATORS

CROSS REFERENCE TO RELATED APPLICATIONS

This application is a continuation of International Patent Application No. PCT/GB2020/051580, entitled "Bracket For Use With Open Display Refrigerators" and filed on Jul. 1, 2020, the entire contents of which are hereby incorporated by reference. International Patent Application No. PCT/GB2020/051580 claims priority to G.B. Application No. 1909707.0, entitled "Bracket For Use With Open Display Refrigerators" and filed on Jul. 5, 2019.

FIELD

The invention relates to brackets for attaching air guides to the shelves of open display refrigerators. The invention also relates to methods of forming such brackets.

BACKGROUND

Open display refrigerators are commonly used in retail environments, such as supermarkets, to store and display products, such as meat and dairy products, which must be kept at lower than ambient temperatures. The open front of such a refrigerator makes it easy for customers to view the products being displayed and to retrieve products they wish to purchase from the refrigerator.

This type of refrigerator has an air curtain, which is established by blowing cold air across the front of the refrigerator. The air curtain issues from an air outlet at the top of the refrigerator towards an air inlet at the bottom of the refrigerator. The air inlet recovers air from the air curtain and recirculates it to the air outlet via a cooling heat exchanger and fan.

Generally, it is intended that the air curtain follows a broadly linear path from the air outlet to the air inlet thereby preventing cold air in the refrigerator from mixing with warm air exterior to the refrigerator. However, such an air curtain is rather inefficient, in particular because the air curtain tends to spill out from the bottom of the refrigerator and warm air from the exterior becomes entrained into the air curtain. To ameliorate this problem of inefficiency, air guides fixed on the front edge of shelves in the refrigerator can be used to help constrain the air curtain within a desired region.

Some refrigerators include sloped shelves in order to better display the top surface of produce on the shelf, for example packets of meat. Where sloped shelves are used, it is common to use transparent risers with the shelves to prevent the displayed produce from sliding off the shelf. If the risers extend from an angled shelf such that a 90° angle is formed between the base of the riser and the shelf, the risers can extend into the air curtain, disrupting the flow of air. A known solution to this problem is to form the risers with an angled profile, such that an acute angle is formed between the base of the riser and the shelf and the risers extend vertically upwards. This prevents the riser from extending into the air curtain and disrupting the flow of air within the air curtain.

To work effectively, the air guides need to be in reasonably good alignment with an outer edge of the air curtain. Historically, this has been achieved by attaching the air guide to the edge of the shelf. However, where the shelves are sloped, such an arrangement can prevent shoppers from viewing produce on a shelf sited below the air guide.

SUMMARY

In accordance with a first aspect of the invention, there is provided a bracket for attaching an air curtain guide to a refrigerator shelf, the bracket comprising: a first end having a surface for engagement with an edge of a refrigerator shelf; a second end for coupling to an air curtain guide; wherein the first end is connected to the second end by a continuous member, such that the first end is offset from the second end in a first direction.

The bracket may be made of a plastic or a metal. The bracket may be engaged to the edge of a refrigerator shelf by any means known to the person skilled in the art, including using screws, bolts, rivets and/or an adhesive. These attaching means may be separate to the bracket or may be integral to the bracket.

A riser may already be attached to the edge of a refrigerator shelf. In particular, the riser may be a riser comprising an angle. In this case, the bracket may be attached to the face of the riser, or may be attached to the shelf through, for example, one or more holes in the riser. In these scenarios, the bracket is still engaged with an edge of the refrigerator shelf, even though the bracket may be partially or wholly attached to the riser.

The surface for engagement with an edge of a refrigerator shelf may be flat. The surface may also comprise grooves or protrusions. The surface may also comprise a surface that conforms to the shape of the edge of the refrigerator shelf. For example, if the edge of the refrigerator comprises a convex curve, the bracket may comprise a concave surface.

The second may be coupled to an air curtain guide by any means known to the person skilled in the art, including using screws, bolts, rivets and/or an adhesive.

Offsetting the first end from the second end may include an offset wherein the first and second ends overlap. Alternatively offsetting the first end from the second end may include an offset wherein the first and second ends do not overlap. The offset may be achieved by forming the member in chicane or S-shape.

A technical advantage of offsetting the first end from the second end is that it allows an air guide to be positioned in reasonably good alignment with an outer edge of the air curtain, without preventing shoppers from viewing produce on a shelf sited below the air guide. This technical advantage arises as the offset of the bracket raises the air guide with respect to the edge of the shelf to which it is attached, thereby reducing the amount that the air guide impedes a user's field of view when viewing a lower shelf.

In some embodiments, the surface is disposed at an angle such that a first plane parallel to the surface would intersect the chord line or an extension of the chord line of a coupled air guide at a desired angle.

The chord line is an imaginary straight line joining the leading and the trailing edges of the air guide. The leading edge of the air guide may be defined as the edge of the air guide which first contacts air in an air flow. The leading edge of the air guide may also or alternatively be defined as the foremost edge of the air guide. The trailing edge may be defined as the edge opposite the leading edge.

The desired angle is the angle that, when in use, causes the bracket to hold the air guide in a position that is substantially parallel to an air curtain, such that the leading edge of the air guide is the edge upon which the air curtain impinges.

For example, if the edge of a refrigerator shelf is at an angle of 20° to an imaginary vertical line, then the angle of the surface will be at 20° to an imaginary vertical line. This is discussed further, with respect to FIG. 8, below.

In some embodiments, the second end comprises first and second attachment clips, each for holding a respective one of a leading edge and a trailing edge of an air curtain guide and wherein a second plane projected through the first and second attachment clips intersects the first plane at a desired angle.

In some embodiments, the bracket further comprises a slot proximate the first end, and wherein the slot is angled such that it is parallel to the surface of the bracket for engagement with an edge of a refrigerator shelf.

Proximate means, for example, that the slot is closer to the first end than to the second end, but is not at the first end itself.

A technical advantage of a bracket comprising a slot that is angled such that it is parallel to the surface is that it enables the bracket to be used with angled risers. An angled riser comprises a first section and a second section, joined at an angle. The slot receives the first part of the riser, such that the second part of the riser extends parallel to the air curtain, when the bracket is in use.

In some embodiments, the bracket further comprises a slot proximate the first end, such that the slot is parallel to the chord line.

Proximate means, for example, that the slot is closer to the first end than to the second end, but is not at the first end itself.

A technical advantage of a bracket comprising a slot that is parallel to the chord line is that it enables the bracket to be used with risers with a rectangular cross-section. When used with a bracket comprising an angled surface and with an angled refrigerator shelf, the slot receives a part of the riser and the riser extends parallel to the air curtain, due to the angled surface of the bracket for engagement with an edge of a refrigerator shelf.

The slot may also be of any other angle, such that when a riser is received in the slot, the part of the riser that extends away from the bracket is broadly parallel to the air curtain of a refrigerator when the bracket is in use.

In some embodiments, the continuous member is in the form of a chicane or is broadly S-shaped.

The member is shaped such that, when the bracket is engaged with the edge of a refrigerator shelf, an air guide coupled at the second end of the bracket is parallel to the air curtain of the refrigerator. The member may be shaped to take the angle of the surface into account.

In some embodiments, the second end comprises at least one hole configured to receive a coupling member, the coupling member for coupling the air curtain guide to the second end.

The hole may be threaded. The coupling member may be means known to the person skilled in the art, including a screw, bolt, rivet, and/or one or more clips. The coupling member may also be threaded.

In some embodiments, the second end comprises at least one coupling member extending from the second end, the coupling member for coupling the air curtain guide to the bracket.

The coupling member may be means known to the person skilled in the art, including a screw, bolt, rivet, and/or one or more clips. The coupling member may be threaded and may be received in a threaded hole in the air guide.

In some embodiments, the desired angle is 10°, 15° or 20°.

In some embodiments, the bracket is attached to an air guide.

The bracket may be removeably attached to the air guide, alternatively the bracket may be integral to the air guide.

In some embodiments, the air guide is an aerofoil.

An aerofoil is a type of air guide that guides air in a specific manner. An aerofoil works by being situated in the air curtain of the refrigerator, with a portion of the air curtain flowing either side of the aerofoil. The aerofoil imparts a shape into the airflow and guides the airflow in a desired direction. The specific shape of the aerofoil causes a change in the direction of flow of the air curtain as it flows over the aerofoil. A typical design of aerofoil that can be used is a cambered aerofoil. This will usually be oriented with the leading edge uppermost and the cambered surface facing away from the interior space. An aerofoil is a shape that gives rise to lower pressures on one side (on the suction surface) compared with the other side (on the pressure surface) when placed in the air curtain.

In accordance with a second aspect of the invention, there is provided an open display refrigerator comprising: a refrigerated storage space, air in the refrigerated storage space being separated from air exterior to the open display refrigerator by an air curtain established by a fan which blows air towards an air outlet, air in the air curtain being recovered by an air inlet which recirculates the air from the air curtain into an air duct coupled to the air outlet; at least one angled shelf, such that a first edge of the shelf proximal the air curtain is lower than an opposite second edge of the shelf distal the air curtain; a bracket according to any one of the aforementioned embodiments, the bracket engaged at the first end with the first edge of the shelf; and an air curtain guide coupled to the second end of the bracket, the air curtain guide for guiding the flow of air within the air curtain.

In some embodiments, the desired angle is 10°, 15° or 20°.

In some embodiments, the air guide in the second aspect is an aerofoil.

An aerofoil is a type of air guide that guides air in a specific manner. An aerofoil works by being situated in the air curtain of the refrigerator, with a portion of the air curtain flowing either side of the aerofoil. The aerofoil imparts a shape into the airflow and guides the airflow in a desired direction. The specific shape of the aerofoil causes a change in the direction of flow of the air curtain as it flows over the aerofoil. A typical design of aerofoil that can be used is a cambered aerofoil. This will usually be oriented with the leading edge uppermost and the cambered surface facing away from the interior space. An aerofoil is a shape that gives rise to lower pressures on one side (on the suction surface) compared with the other side (on the pressure surface) when placed in the air curtain.

In accordance with a third aspect of the invention, there is provided a method of selecting an angle for the face of the bracket of the second aspect, comprising: measuring the angle of the edge of the shelf, wherein the angle of the edge of the shelf is measured with respect to an imaginary vertical line when the shelf is in use; and forming the surface of the bracket at the measured angle, with respect to the imaginary vertical line.

BRIEF DESCRIPTION OF THE DRAWINGS

Embodiments of the invention will now be described with reference to the accompanying drawings, in which.

DETAILED DESCRIPTION

Figure 1:
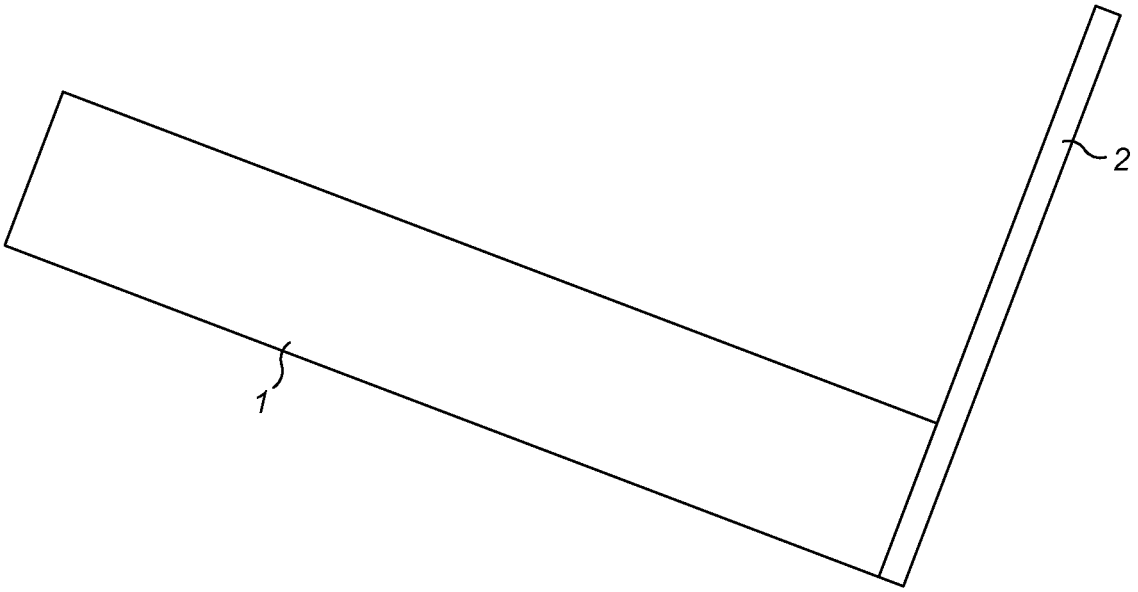
FIG. 1 is a schematic diagram of a cross-section through an angled refrigerator shelf with a riser attached to the refrigerator shelf.

FIG. 1 shows a cross-section through an angled refrigerator shelf 1. The shelf 1 has a riser 2 attached to an edge of the shelf 1. In use, the riser 2 impinges on the air curtain of a refrigerator, as the riser protrudes into the air flow of the air curtain.

Figure 2:
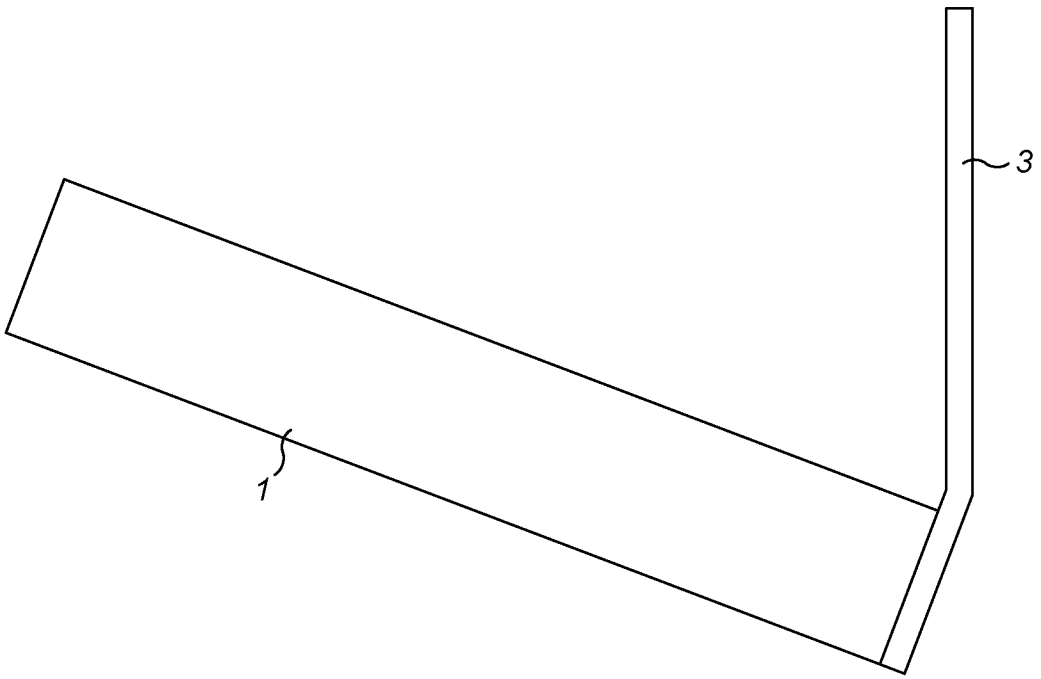
FIG. 2 is a schematic diagram of an angled refrigerator shelf with an angled riser attached to the angled refrigerator shelf.

FIG. 2 shows a cross-section through an angled refrigerator shelf 1. The shelf 1 has an angled riser 3 attached to an edge of the shelf 1. The angle of the angled riser 3 helps to prevent the riser from impinging on the air curtain of a refrigerator in use. If an air guide is also attached to the edge of the shelf 1, this can prevent shoppers from viewing produce on a shelf sited below the air guide.

Figure 3:
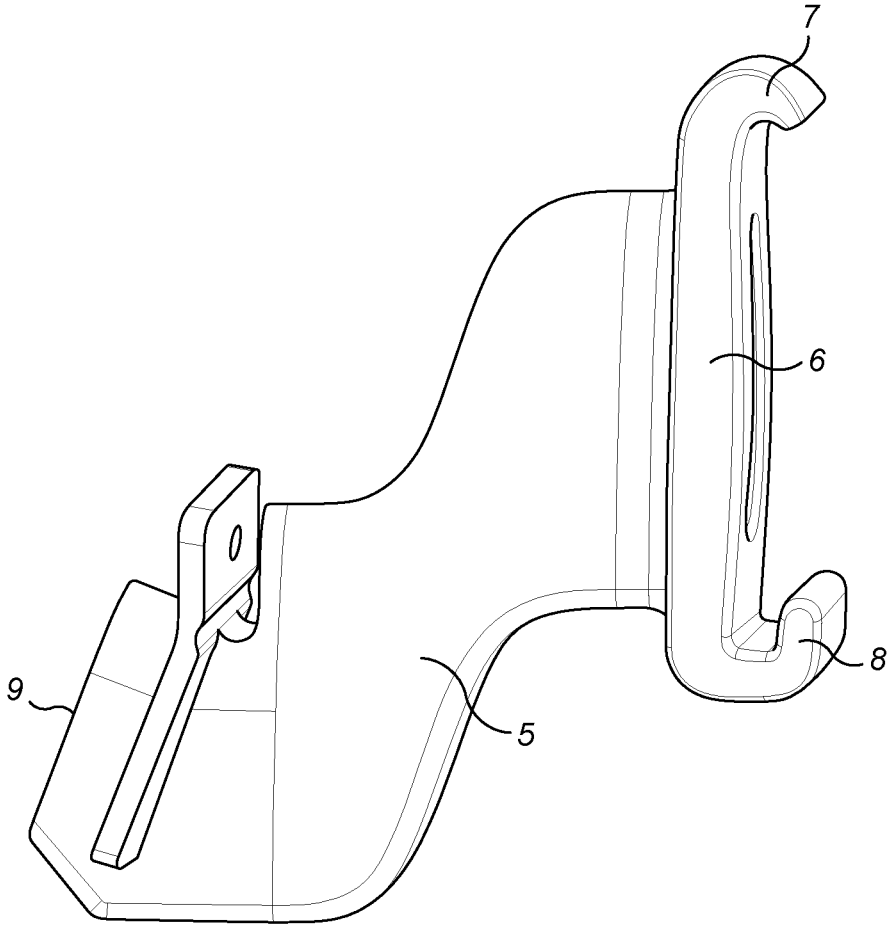
FIG. 3 shows a bracket for holding an air guide, the bracket use with an angled riser.

FIG. 3 shows a bracket 5 for holding an air guide. The bracket 5 may be S-shaped, a chicane shape or a swan-neck shape. Alternatively, the bracket may comprise a rectangular cross-section or be any other shape that translates the angled edge of the shelf such that an air guide coupled to the end of the bracket not engaged with the edge of the shelf is parallel to an air curtain of a refrigerator in use. An angled surface 9 of the bracket can be coupled to an edge of a refrigerator shelf. As seen in FIGS. 1 and 2, due to the angle of the refrigerator shelf, the edge of the refrigerator shelf is at an angle to an imaginary vertical line. The angled surface of the bracket may match this angle. This causes the second end of the bracket comprising, for example, a clip 6 for coupling to an air guide to be parallel to a vertical air curtain in use. The bracket translates the angled edge of the shelf, so that an air guide coupled to the clip is parallel to the air curtain in use. The clip 6 may comprise a first end 7 for retaining a leading edge of an air guide and a second end 8 for retaining a trailing edge of an air guide. The bracket may also comprise an angled slot for retaining an angled riser. This slot may be angled such that it is parallel to the angled surface 9.

Figure 4:
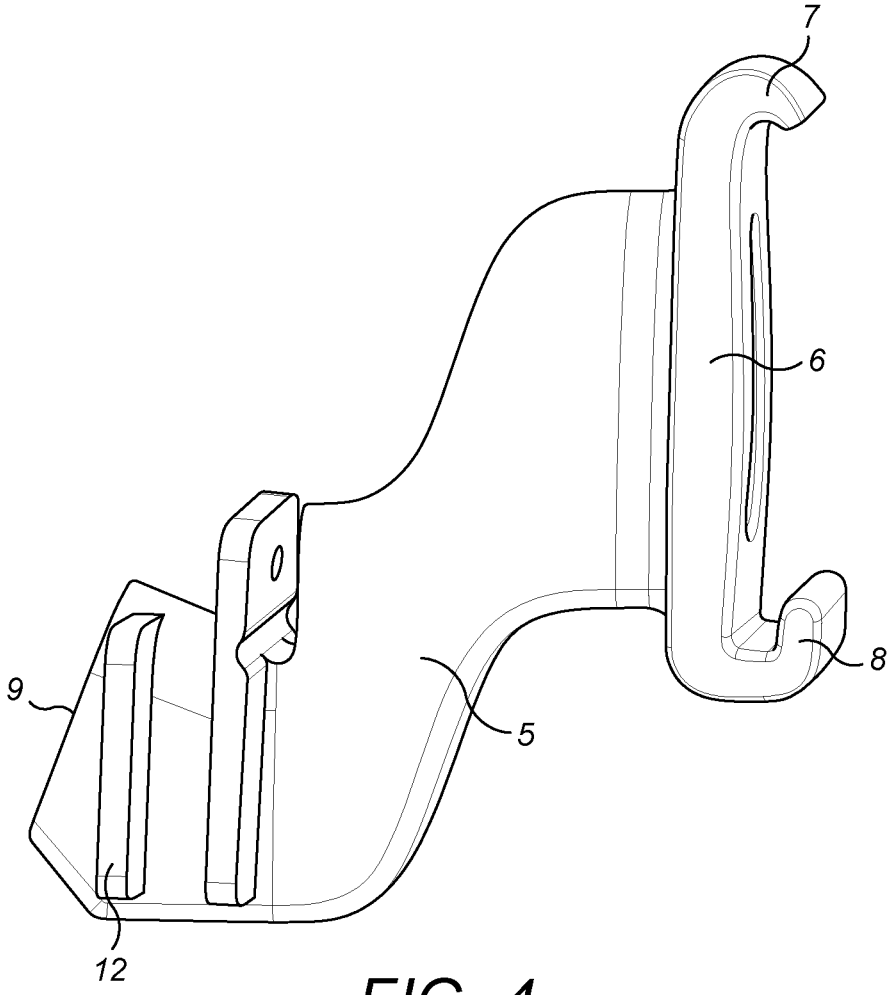
FIG. 4 shows a bracket for holding an air guide, the bracket for use with a riser having a rectangular cross-section.

FIG. 4 shows a broadly similar bracket 5 to the bracket shown in FIG. 3. In this embodiment, the bracket further comprises a vertical slot 12 for retaining a riser with a rectangular cross-section. In use, this prevents the riser from impinging on an air curtain.

Figure 5:
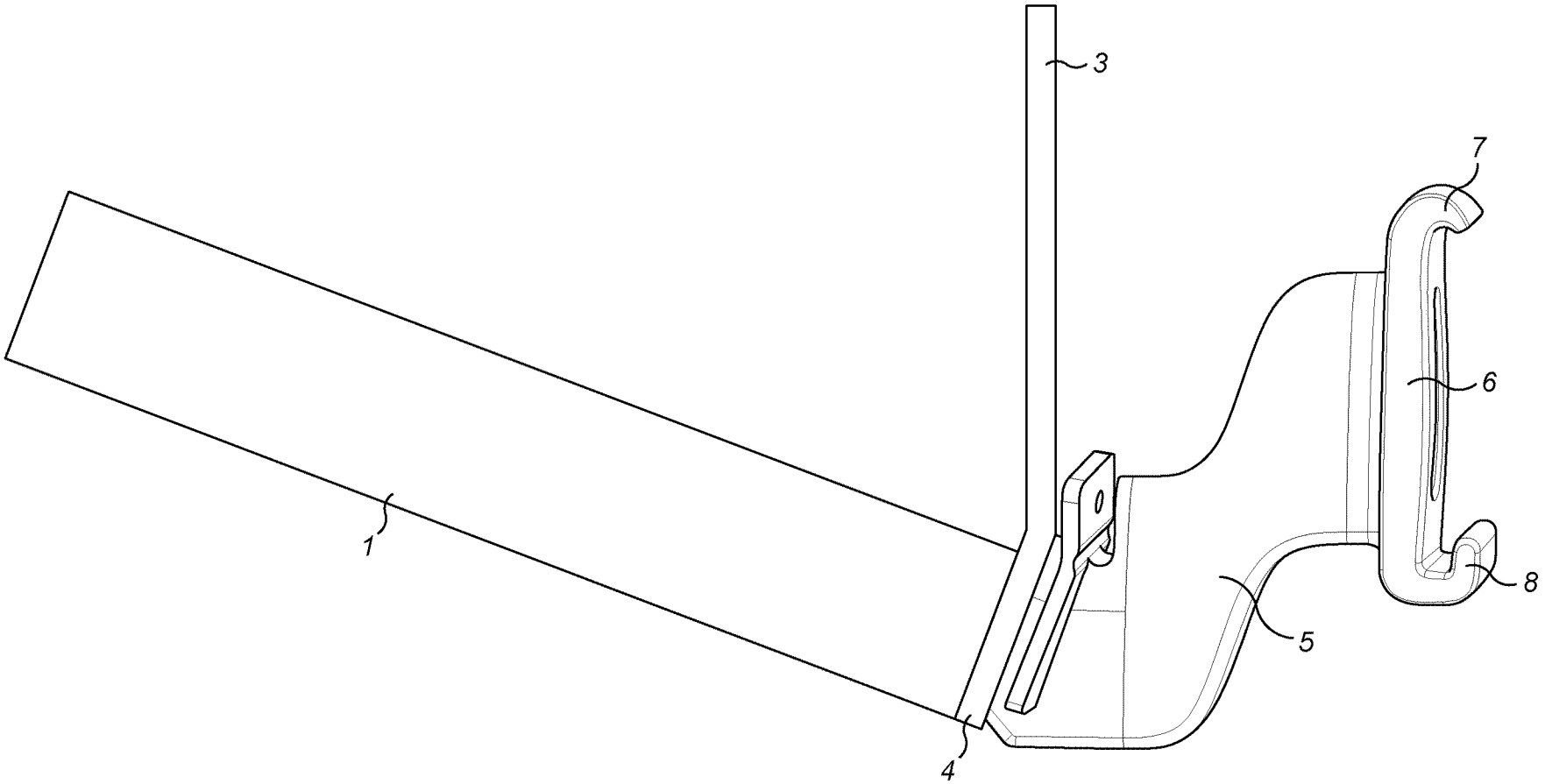
FIG. 5 is a schematic diagram of an angled refrigerator shelf, with an angled riser attached to the angled refrigerator shelf and a bracket for holding an air guide engaged to the edge of the refrigerator shelf.

FIG. 5 illustrates schematically the bracket 5 of FIG. 3 in use. The angled surface of the bracket is attached to the edge of an angled refrigerator shelf 1. As can be seen, the bracket 5 translates the angled edge of the shelf to a clip that can retain an air guide parallel to an air curtain. Further, the air guide is moved above the edge of the angled shelf 1, thereby improving the view of items stored on a shelf below. The bracket 5 may comprise an angled slot for receiving a first end 4 of an angled riser 3, such that the second end of the riser is parallel with an air curtain in use and does not impinge the air curtain.

Figure 6:
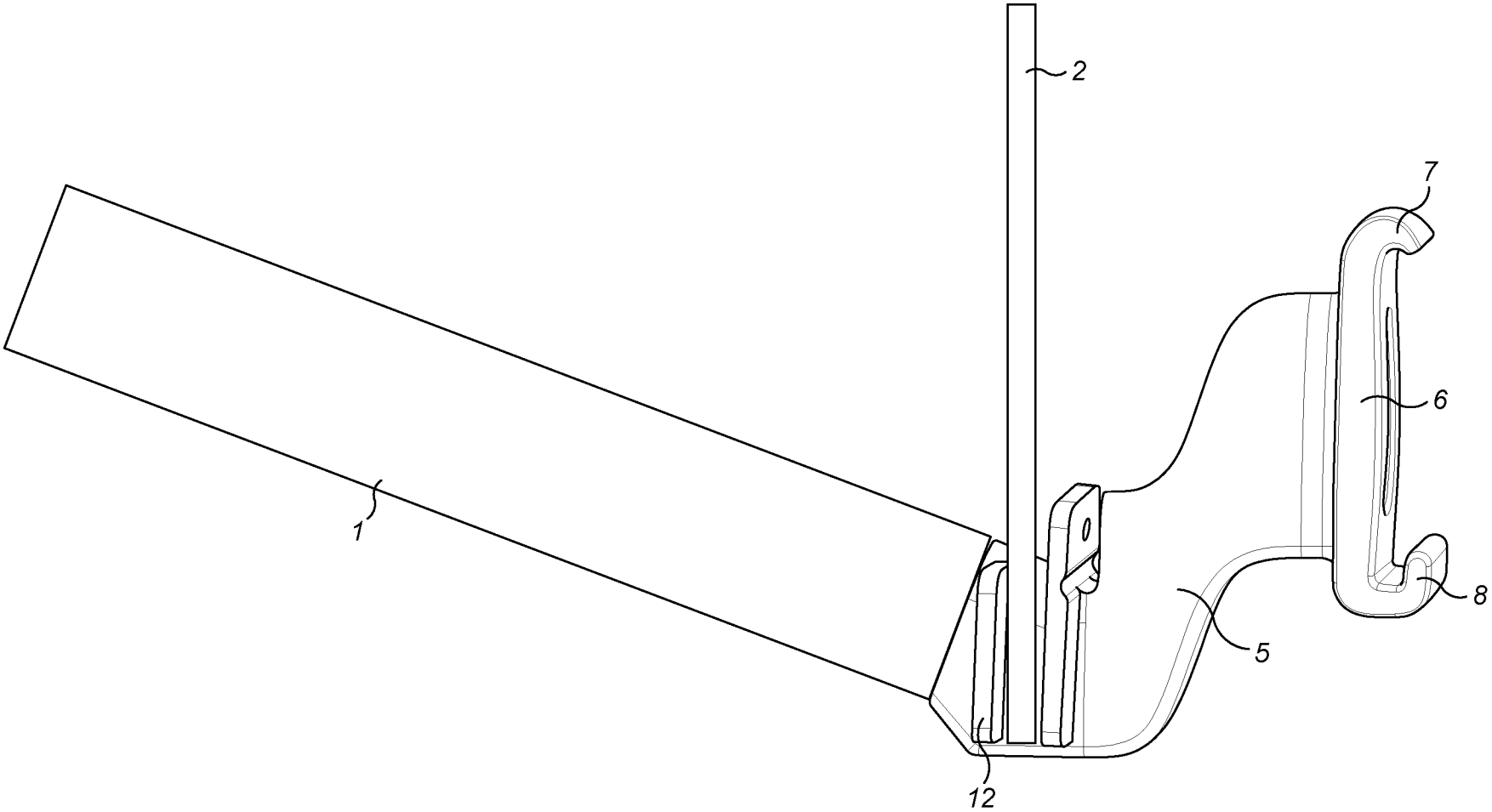
FIG. 6 is a schematic diagram of an angled refrigerator shelf, with a riser having a rectangular cross-section attached to the angled refrigerator shelf and a bracket for holding an air guide engaged to the edge of the refrigerator shelf.

FIG. 6 illustrates schematically the bracket 5 of FIG. 4 in use. The angled surface of the bracket is attached to the edge of an angled refrigerator shelf 1. As can be seen, the bracket 5 translates the angled edge of the shelf to a clip that can retain an air guide parallel to an air curtain. Further, the air guide is moved above the edge of the angled shelf 1, thereby improving the view of items stored on a shelf below. The bracket 5 may comprise a slot for receiving a first end of a riser with a rectangular cross section 2, such that the second end of the riser is parallel with an air curtain in use and does not impinge the air curtain.

Figure 7:
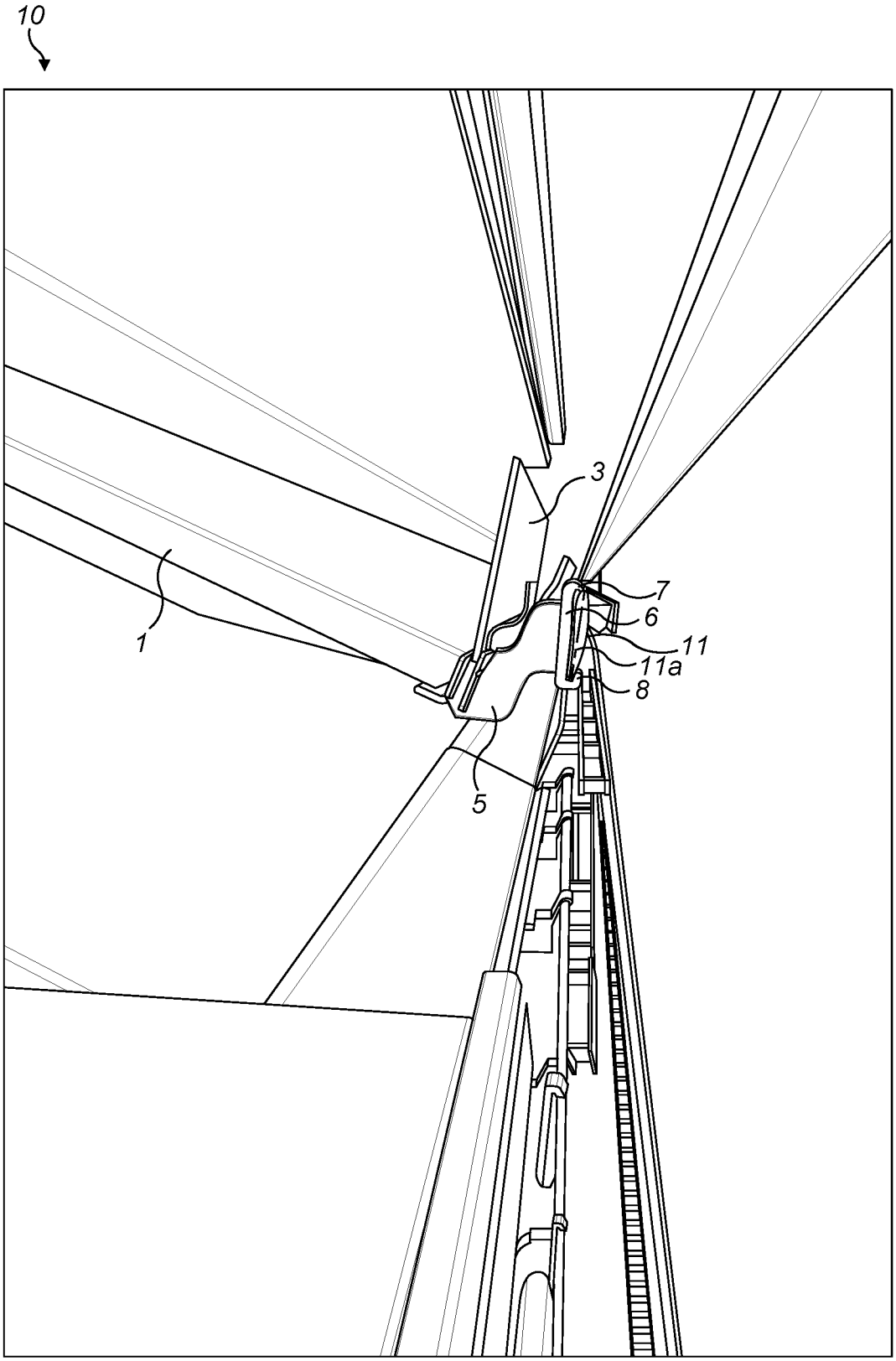
FIG. 7 shows an angled refrigerator shelf, with an angled riser attached to the angled refrigerator shelf and a bracket engaged to the edge of the refrigerator shelf, an air curtain guide coupled to the bracket.

FIG. 7 shows a solution, as provided by the present invention, to the problem associated with attaching air guides to the edges of angled shelves in a refrigerator. The open display refrigerator 10 has angled shelves 1, comprising a riser 3 and a bracket 5. The bracket 5 comprises a clip 6, which comprises a first end 7 for retaining a leading edge of an air guide 11 and a second end 8 for retaining a trailing edge of the air guide 11. As can be seen, by raising the air guide 11 from the edge of the shelf, it is easier for a user to view products on the angled shelf below an air guide 11 due to the increase in space between the lower edge of the air guide 11 and the top surface of the shelf below the air guide 11. Chord line 11*a* of air guide 11 is parallel to riser 3.

Figure 8:
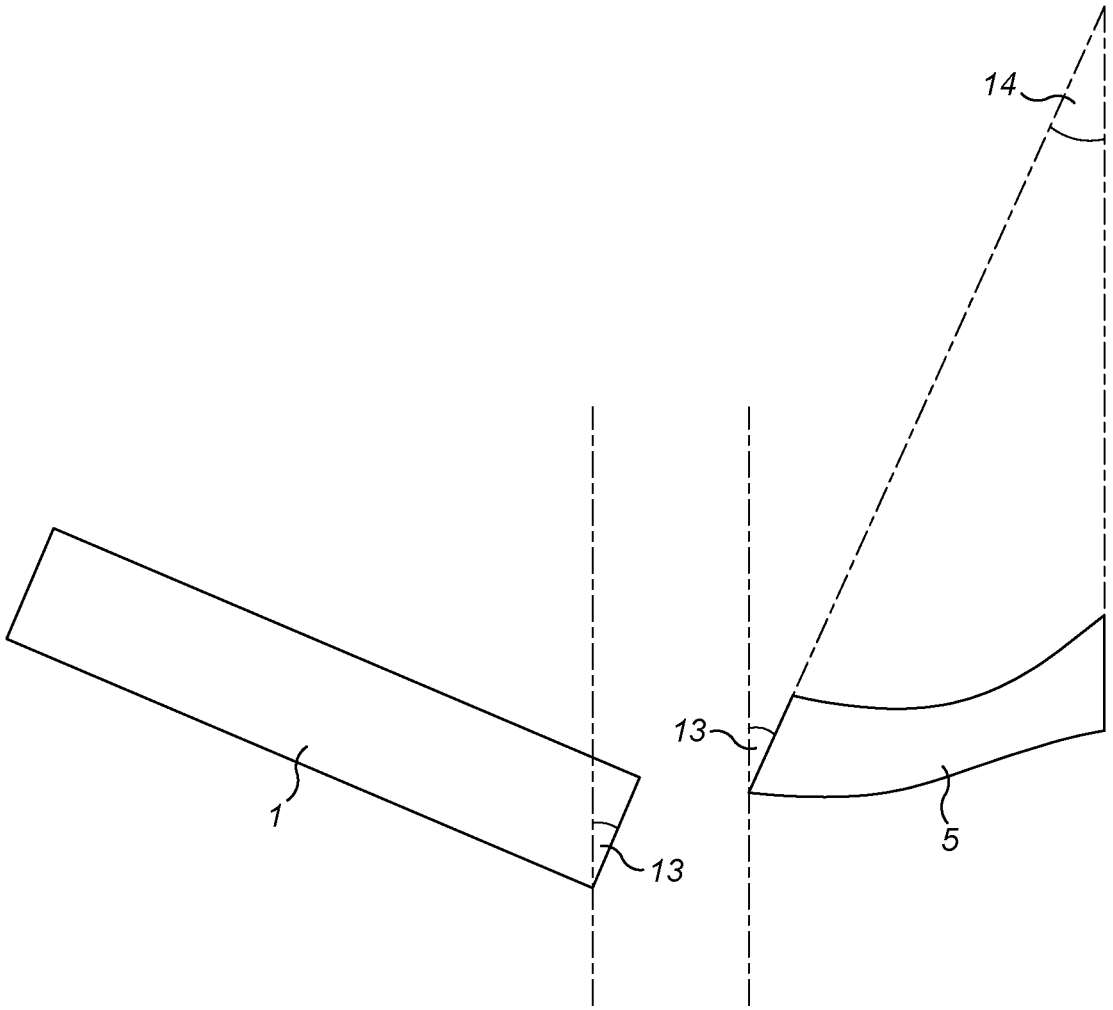
FIG. 8 is a schematic diagram of how the angles referred to above are measured.

FIG. 8 shows an angled shelf 1, with an edge at an angle 13. The bracket 5 has a surface also at an angle 13, which matches the angle of the edge of the angled shelf. The desired angle 14 is the same as the angle 13.

The invention claimed is:

1. An apparatus, comprising:

a shelf disposed within a refrigerator, the shelf inclined such that a front portion of the shelf is lower than a rear portion of the shelf; a bracket having a first end, a middle portion, and a second end, the first end of the bracket coupled to the shelf, the middle portion of the bracket disposed between the first end of the bracket and the second end of the bracket such that the second end of the bracket is offset (i) horizontally from the first end of the bracket such that the second end of the bracket is disposed away from the shelf and (ii) vertically such that the second end of the bracket is disposed above the first end of the bracket; a riser disposed in a slot defined by the bracket, the riser configured to prevent a product from sliding off the shelf and an air guide coupled to the second end of the bracket, the riser and air guide parallel to an air curtain produced by the refrigerator and at an angle to the shelf, wherein the air guide includes leading and trailing edges and upright inner and outer surfaces extending between the leading and trailing edges, wherein the inner surface of the air guide is spaced apart from an outer surface of the riser to form a gap whereby at least some air can flow through the gap, wherein the trailing edge of the air guide is offset vertically above a plane of an upper surface of the shelf where the plane passes below the air guide, wherein the vertical offset improves a view of items stored below the shelf.

2. The apparatus of claim 1, wherein:

a chord line of the air guide is parallel to a surface of the riser.

3. The apparatus of claim 1, wherein:

a chord line of the air guide is parallel to the slot defined by the bracket.

4. The apparatus of claim 1, wherein:

the shelf is inclined at an angle of at least 10 degrees.

5. The apparatus of claim 1, wherein:

the air guide is an airfoil.

6. The apparatus of claim 5, wherein:

a plane parallel to a surface of the first end of the bracket intersects a line defined by a chord of the airfoil.

7. The apparatus of claim 1, wherein:

the shelf is inclined at an angle greater than 10 degrees.

8. The apparatus of claim 1, wherein:

the riser has a rectangular cross section.

9. An apparatus, comprising:

a housing defining a refrigerated storage space;

an air outlet configured to form an air curtain over an open front of the refrigerated storage space;

a shelf disposed within the refrigerated storage space, the shelf inclined such that a front portion of the shelf is lower than a rear portion of the shelf;

a riser configured to prevent a product from sliding off the shelf, the riser aligned with the air curtain;

an air guide aligned with the air curtain;

wherein the air guide includes leading and trailing edges and upright inner and outer surfaces extending between the leading and trailing edges, and wherein the inner surface of the air guide is spaced apart from an outer surface of the riser to form a gap whereby at least some air can flow through the gap; and a bracket coupling the air guide to the shelf, a first end of the bracket offset from a second end of the bracket such that the trailing edge of the air guide is disposed vertically above a plane of an upper surface of the shelf where the plane passes below the air guide to improve a view of items stored below the shelf.

10. The apparatus of claim 9, wherein:

the riser is coupled to the shelf.

11. The apparatus of claim 9, wherein:

the riser is disposed in a slot defined by the bracket.

12. The apparatus of claim 9, wherein:

the riser has a rectangular cross section; and the riser is disposed in a rectangular slot defined by the bracket.

13. The apparatus of claim 9, wherein:

the bracket is S-shaped.

14. The apparatus of claim 9, wherein:

the bracket and the air guide are monolithically formed.

15. The apparatus of claim 9, wherein:

the shelf is inclined at least 10 degrees.

16. The apparatus of claim 9, wherein:

the shelf is inclined at least 15 degrees.

* * * * *